US010113703B2

(12) United States Patent
Okubo

(10) Patent No.: US 10,113,703 B2
(45) **Date of Patent: *Oct. 30, 2018**

(54) VEHICLE HEADLAMP FOR FORMING SPOT AND DIFFUSION LIGHT DISTRIBUTION PATTERNS

(71) Applicant: ICHIKOH INDUSTRIES, LTD., Isehara-shi, Kanagawa-ken (JP)

(72) Inventor: Yasuhiro Okubo, Isehara (JP)

(73) Assignee: ICHIKOH INDUSTRIES, LTD., Isehara-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/309,895

(22) PCT Filed: Apr. 10, 2015

(86) PCT No.: PCT/JP2015/061249

§ 371 (c)(1),
(2) Date: Nov. 9, 2016

(87) PCT Pub. No.: WO2015/174179

PCT Pub. Date: Nov. 19, 2015

(65) Prior Publication Data

US 2017/0146209 A1 May 25, 2017

(30) Foreign Application Priority Data

May 12, 2014 (JP) ..... 2014-098962

(51) Int. Cl.
*F21V 1/00* (2006.01)
*F21S 41/14* (2018.01)
(Continued)

(52) U.S. Cl.
CPC ..... *F21S 41/14* (2018.01); *F21S 41/25* (2018.01); *F21S 41/32* (2018.01);
(Continued)

(58) Field of Classification Search
CPC .. F21S 48/1145; F21S 48/125; F21S 48/1317; F21S 41/14; F21S 41/32
(Continued)

(56) References Cited

U.S. PATENT DOCUMENTS 7,311,430 B2 * 12/2007 Tsukamoto ..... F21S 48/1159 362/517
2008/0144328 A1 6/2008 Yagi et al.

FOREIGN PATENT DOCUMENTS

DE 10 2007 061 304 A1 6/2008
EP 2 020 336 A1 2/2009
(Continued)

OTHER PUBLICATIONS

Japanese Office Action issued in corresponding application No. 2014-098962 dated Dec. 5, 2017 with English translation.

*Primary Examiner* — Anh Mai
*Assistant Examiner* — Hana Featherly
(74) *Attorney, Agent, or Firm* — Foley & Lardner LLP

(57) ABSTRACT

The present invention is provided with semiconductor light sources, reflectors, and lenses. The semiconductor light sources have a light-emitting surface. The reflectors have reflection surfaces comprising free-form surfaces. The lenses comprise a convex lens and a concave lens. As a result, the present invention is able to accurately control the light distribution of a predetermined light distribution pattern.

5 Claims, 14 Drawing Sheets

(51) Int. Cl.
*F21S 8/10* (2006.01)
*F21S 41/25* (2018.01)
*F21S 41/32* (2018.01)

(52) U.S. Cl.
CPC ..... *F21S 48/1145* (2013.01); *F21S 48/125* (2013.01); *F21S 48/1317* (2013.01)

(58) Field of Classification Search
USPC ..... 362/509
See application file for complete search history.

(56) References Cited

FOREIGN PATENT DOCUMENTS

| | | | |
|---|---|---|---|
| EP | 2 103 867 | A2 | 9/2009 |
| JP | 2000-040411 | A | 2/2000 |
| JP | 2008-153123 | A | 7/2008 |
| JP | 2008-153124 | A | 7/2008 |
| JP | 2012-238451 | A | 12/2012 |

* cited by examiner

VEHICLE HEADLAMP FOR FORMING SPOT AND DIFFUSION LIGHT DISTRIBUTION PATTERNS

TECHNICAL FIELD

The present invention relates to a vehicle headlamp which is provided with a semiconductor light source, a reflector, and a lens.

BACKGROUND ART

Conventionally, vehicle headlamps of such a type are known (for example, Patent Literature 1 and Patent Literature 2). Hereinafter, conventional vehicle headlamps will be described. A conventional vehicle headlamp of Patent Literature 1 is provided with: a concave lens; a plurality of light emitting elements; and a reflector having an elliptical reflection surface, and radiates a predetermined light distribution pattern to a front side of a vehicle. A conventional vehicle headlamp of Patent Literature 2 is provided with: a convex lens and a concave lens; a plurality of light emitting elements; and an elliptical reflection surface and a hyperbolic reflection surface, and radiates a predetermined light distribution pattern to a front side of a vehicle.

CITATION LIST

Patent Literature

Patent Literature 1: Japanese Unexamined Patent Application Publication No. 2008-153123

Patent Literature 2: Japanese Unexamined Patent Application Publication No. 2008-153124

SUMMARY OF THE INVENTION

Problems to be Solved by the Invention

In the vehicle headlamp, it is important to accurately control light distribution of a predetermined light distribution pattern A problem to be solved by the present invention is that it is important to accurately control the light distribution of the predetermined light distribution pattern.

A vehicle headlamp according to the present invention (first aspect) comprising: a semiconductor light source; reflector; and a lens wherein the semiconductor light source has a light-emitting surface, the reflector has a reflection surface to reflect light from the light-emitting surface to the lens's side, the reflection surface is composed of a free-form surface; the light-emitting surface inclines so as to face the reflection surface with respect to an optical axis of the reflection surface, and the lens is made of a convex lens or a concave lens or a convex lens and a concave lens, and radiates to a front side of a vehicle, the light from the light-emitting surface, the light having been reflected by means of the reflection surface, as predetermined light distribution patterns.

The vehicle headlamp according to the present invention (second aspect), wherein the semiconductor light source comprises at least a spot semiconductor light source and a diffusion semiconductor light source, the reflection surface comprises: at least a spot reflection surface which corresponds to the spot semiconductor light source; and a diffusion reflection surface which corresponds to the diffusion semiconductor light source, the lens comprises: at least a spot lens which corresponds to the spot semiconductor light source and the spot diffusion reflection surface; and a diffusion lens which corresponds to the diffusion semiconductor light source and the diffusion reflection surface, the spot semiconductor light source, the spot reflection surface, and the spot lens form a spot light distribution pattern of the predetermined light distribution patterns, and the diffusion semiconductor light source, the diffusion reflection surface, and the diffusion lens form a diffusion light distribution pattern of the predetermined light distribution patterns.

The vehicle headlamp according to the present invention (third aspect), wherein the spot semiconductor light source, the spot reflection surface, and the spot lens are disposed inside the vehicle, and the diffusion semiconductor light source, the diffusion reflection surface, and the diffusion lens are disposed outside the vehicle.

The vehicle headlamp according to the present invention (fourth aspect), wherein the optical axis of the diffusion reflection surface faces the outside of the vehicle with respect to the optical axis of the spot reflection surface.

The vehicle headlamp according to the present invention (fifth aspect), wherein the spot lens is a convex lens, and the diffusion lens is a concave lens.

Effect of the Invention

In so far as the vehicle headlamp of the present invention is concerned, a reflection surface is designed in advance so that reflection light is reflected in an opening direction, and the reflection light that has been reflected in the opening direction is corrected to travel along a normal optical path by means of a convex lens. In addition, a reflection surface is designed in advance so that reflection light is reflected in a crossing direction, and the reflection light that has been reflected in the opening direction is corrected to travel along the normal optical path by means of a concave lens. Therefore, it is possible to accurately control the light distribution of a predetermined light distribution pattern.

MODE FOR CARRYING OUT THE INVENTION

Hereinafter, four examples of embodiments (exemplary embodiments) of a vehicle headlamp according to the present invention will be described in detail with reference to the drawings. It is to be noted that the present invention is not limited by the embodiments. In the specification and the claims appended herewith, the terms "forward", "backward", "upper", "lower", "leftward", and "rightward" directions respectively designate the forward, backward, upper, lower, leftward, and rightward directions in a case where the vehicle headlamp according to the present invention has been mounted on a vehicle.

Figure 1:
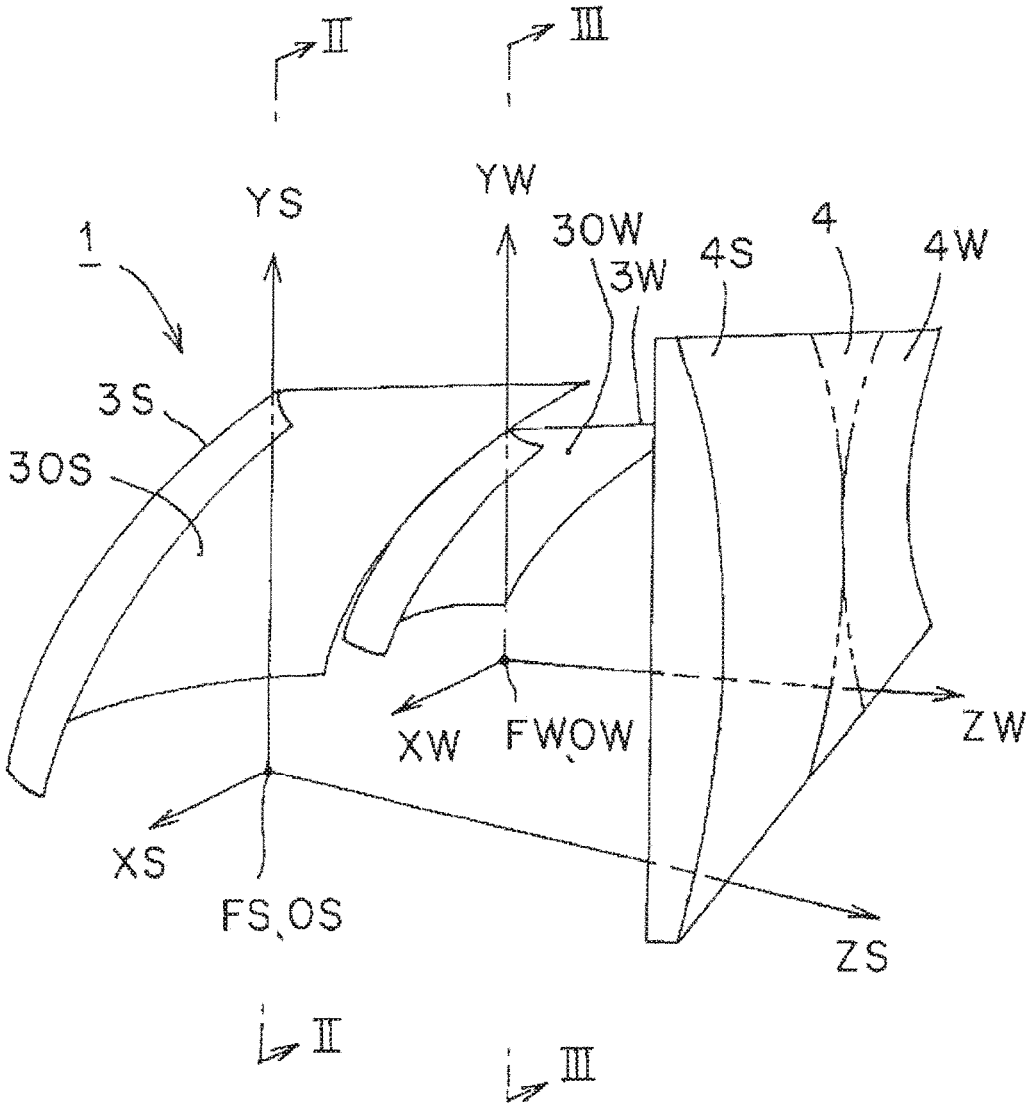
FIG. 1 is a schematic perspective view showing a first embodiment of a vehicle headlamp according to the present invention.
Figure 4:
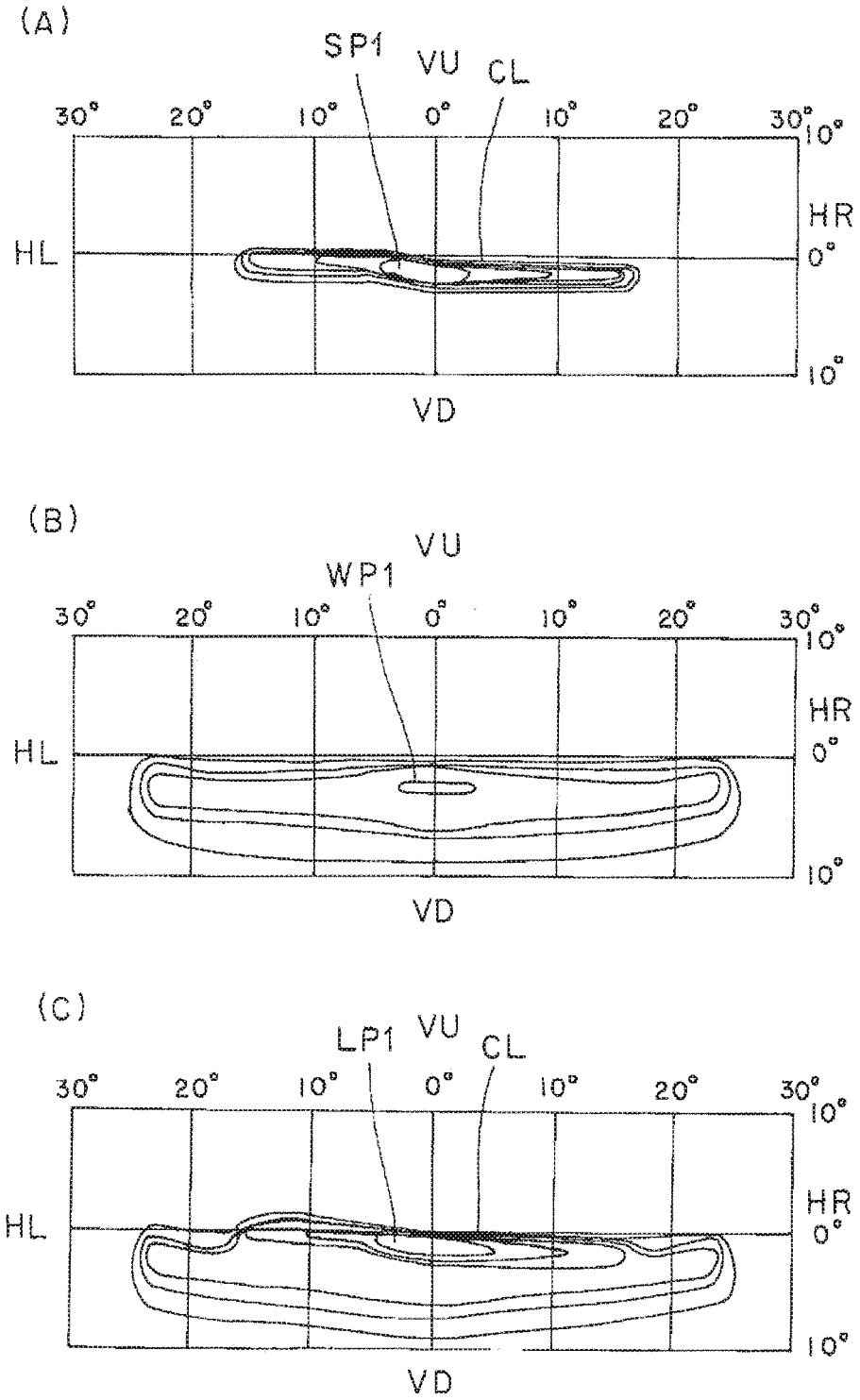
FIG. 4 is an explanatory view showing a predetermined light distribution pattern.
Figure 5:
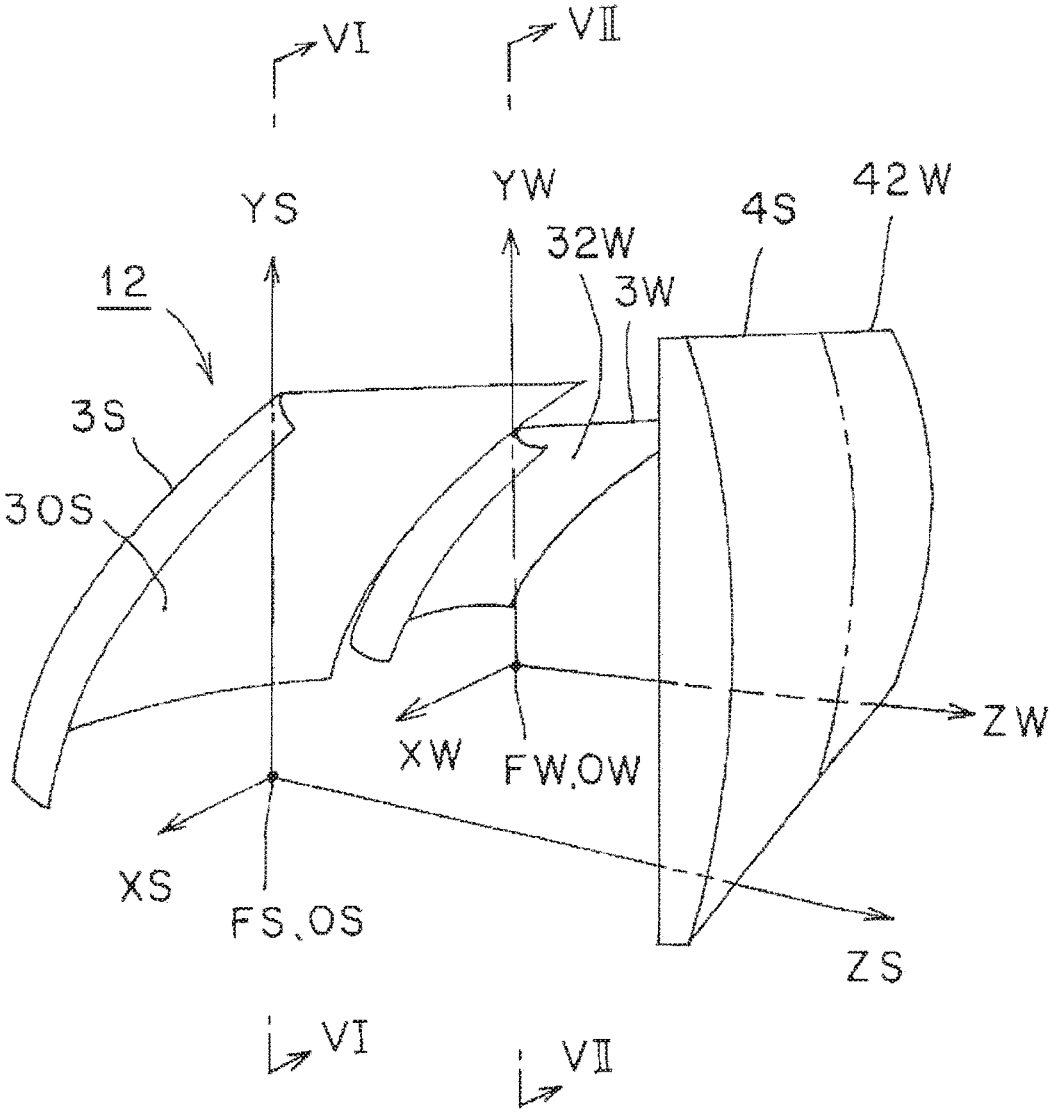
FIG. 5 is a schematic perspective view showing a second embodiment of a vehicle headlamp according to the present invention.
Figure 6:
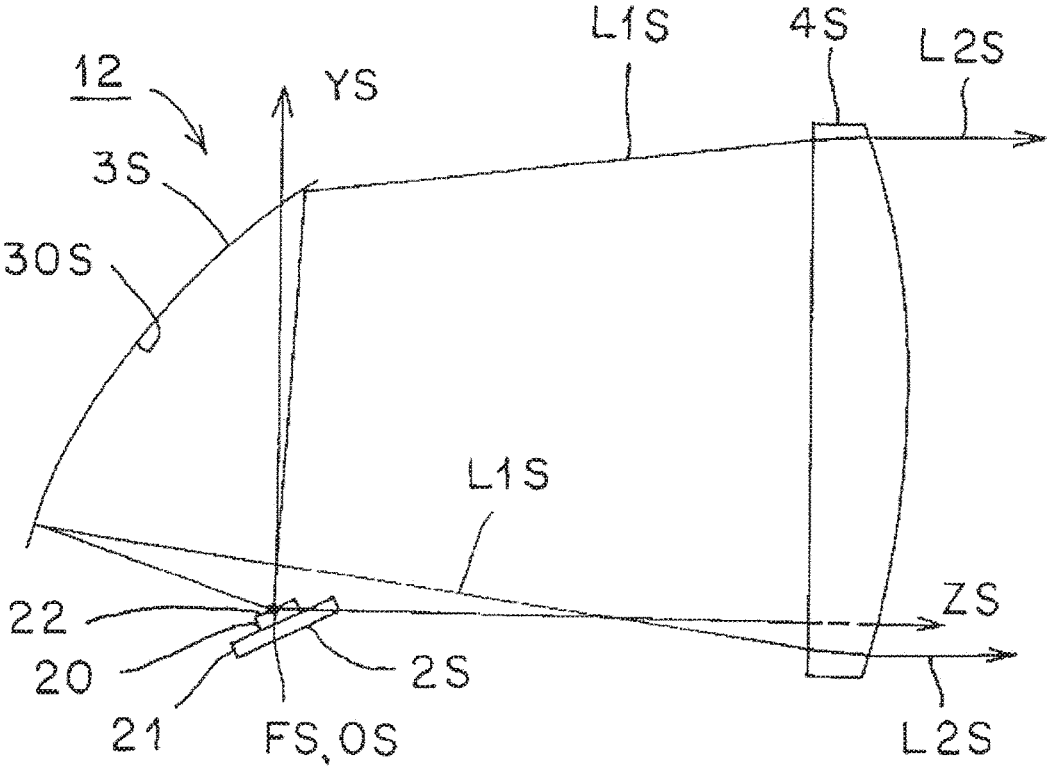
FIG. 6 is a schematic sectional view taken along the line VI-VI in FIG. 5.
Figure 7:
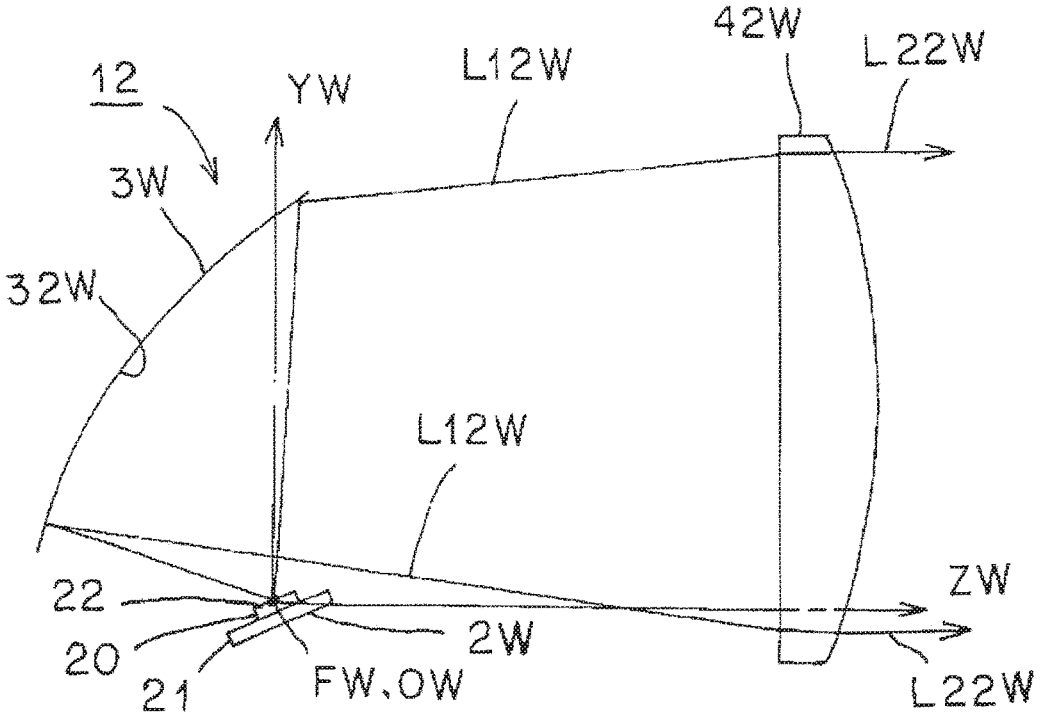
FIG. 7 is a schematic sectional view taken along the line VII-VII in FIG. 5.
Figure 8:
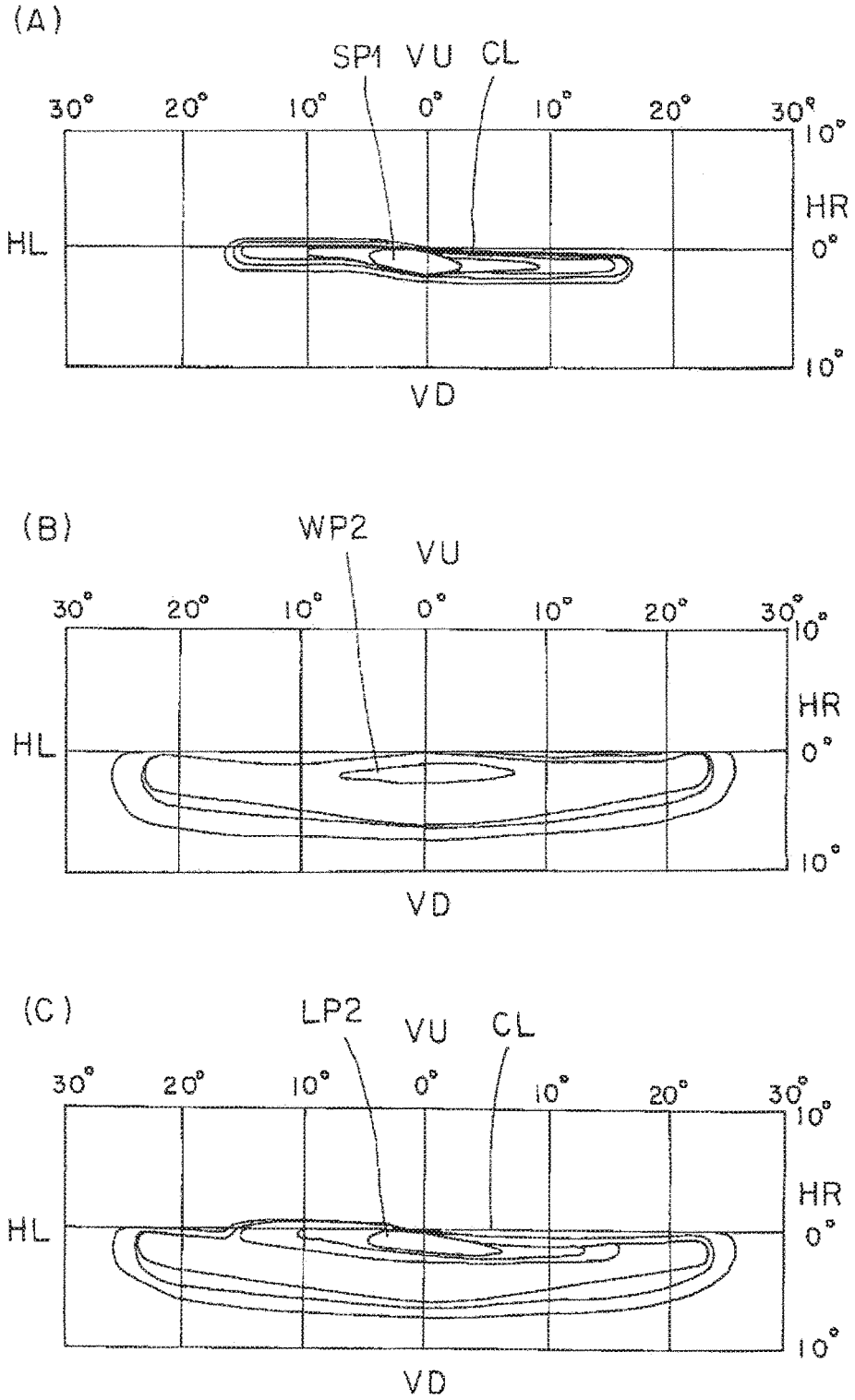
FIG. 8 is an explanatory view showing a predetermined light distribution pattern.
Figure 9:
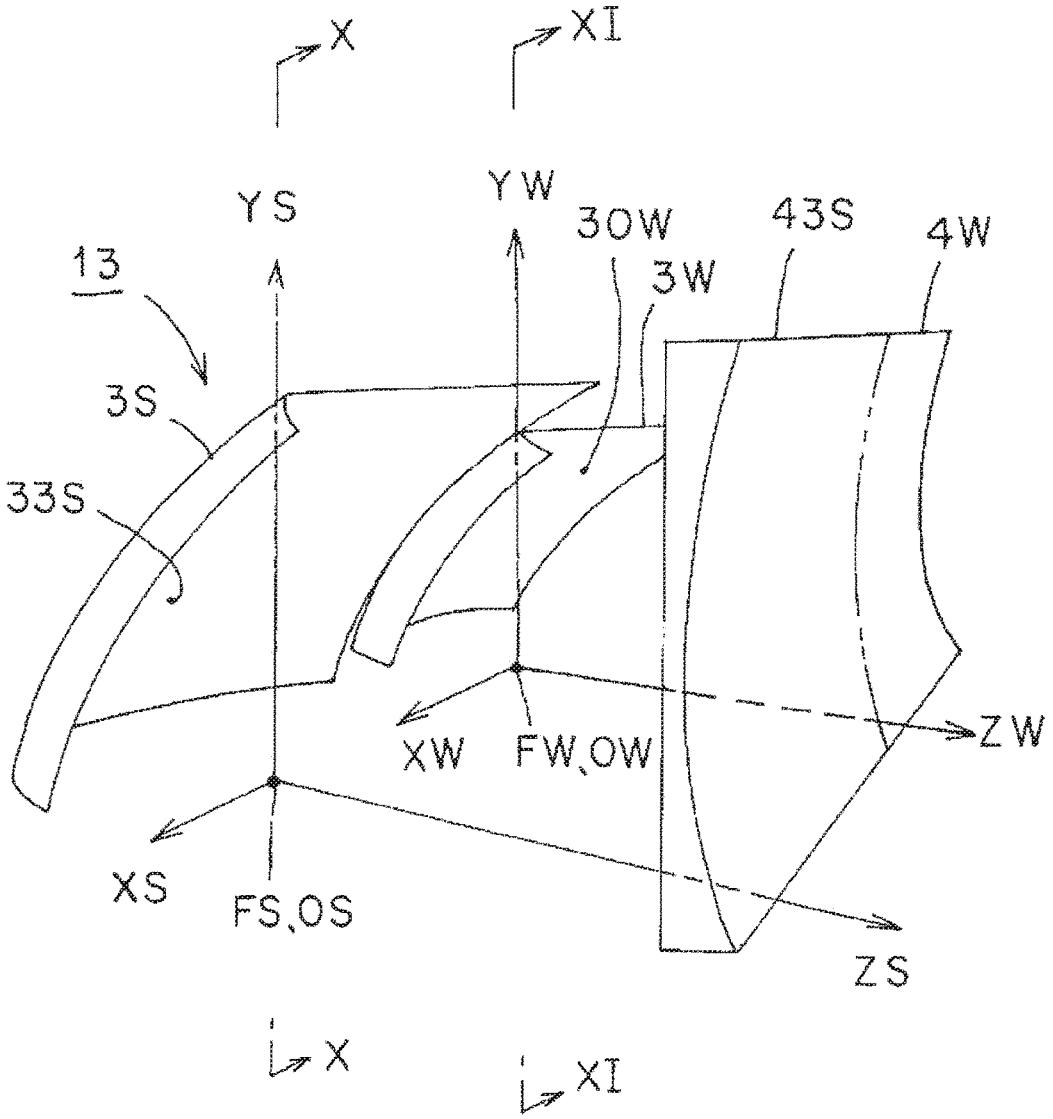
FIG. 9 is a schematic perspective view showing a third embodiment of a vehicle headlamp according to the present invention.
Figure 12:
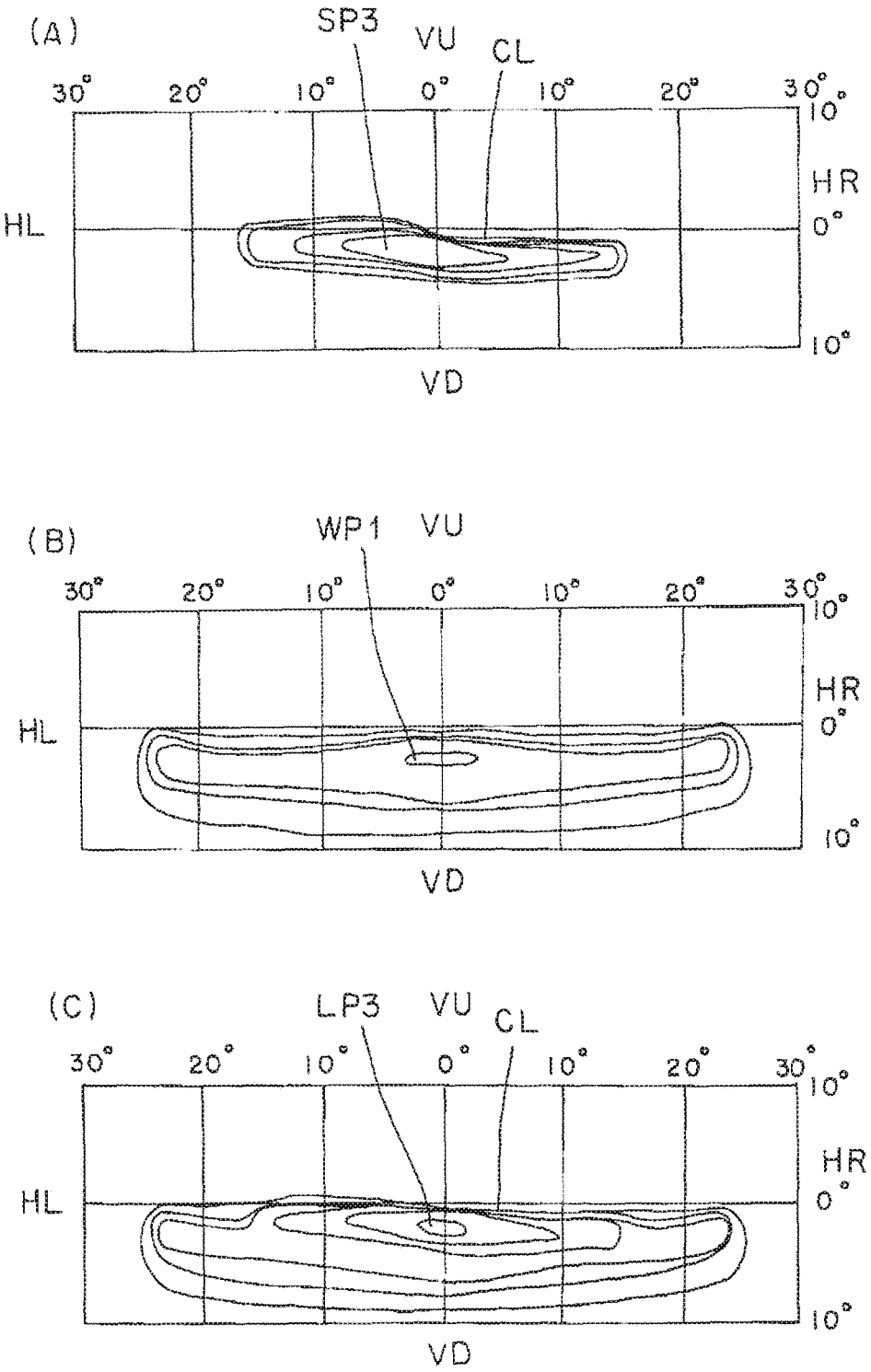
FIG. 12 is an explanatory view showing a predetermined light distribution pattern.

In FIG. 1, FIG. 5, and FIG. 9, illustrations of semiconductor light sources are omitted. In FIG. 2, FIG. 3, FIG. 6, FIG. 7, FIG. 10, and FIG. 11, hatchings of lenses are omitted. In FIG. 4, FIG. 8, and FIG. 12, the reference sign "VU-VD" designates a vertical line from the top to bottom of a screen, and the reference sign "HL-HR" designates a horizontal line from the left to right of the screen. In addition, FIG. 4, FIG. 8, and FIG. 12 are explanatory views of equi-intensity curve of light which briefly show light distribution patterns on the screen that is produced by computer simulation, wherein a central equi-intensity curve of light is a high intensity zone, and the other curves are intensity zones which become lower towards the outside.

(Description of Configuration of First Embodiment)

FIG. 1 to FIG. 4 each shows a first embodiment of a vehicle headlamp according to the present invention. Hereinafter, a configuration of the vehicle headlamp in the first embodiment will be described. In FIG. 1, reference numeral 1 designates the vehicle headlamp (such as a headlamp, for example) in the first embodiment. The vehicle headlamp 1 is mounted to each of the left and right end parts at a front part of a vehicle for left side cruising. Hereinafter, a left side vehicle headlamp 1 which is mounted at the left side of the vehicle will be described. It is to be noted that a right side vehicle headlamp which is mounted at the right side of the vehicle forms constituent elements which are substantially similar to those of the left side vehicle headlamp 1; and therefore, a duplicate description thereof is omitted.

(Description of Vehicle Headlamp 1)

Figure 2:
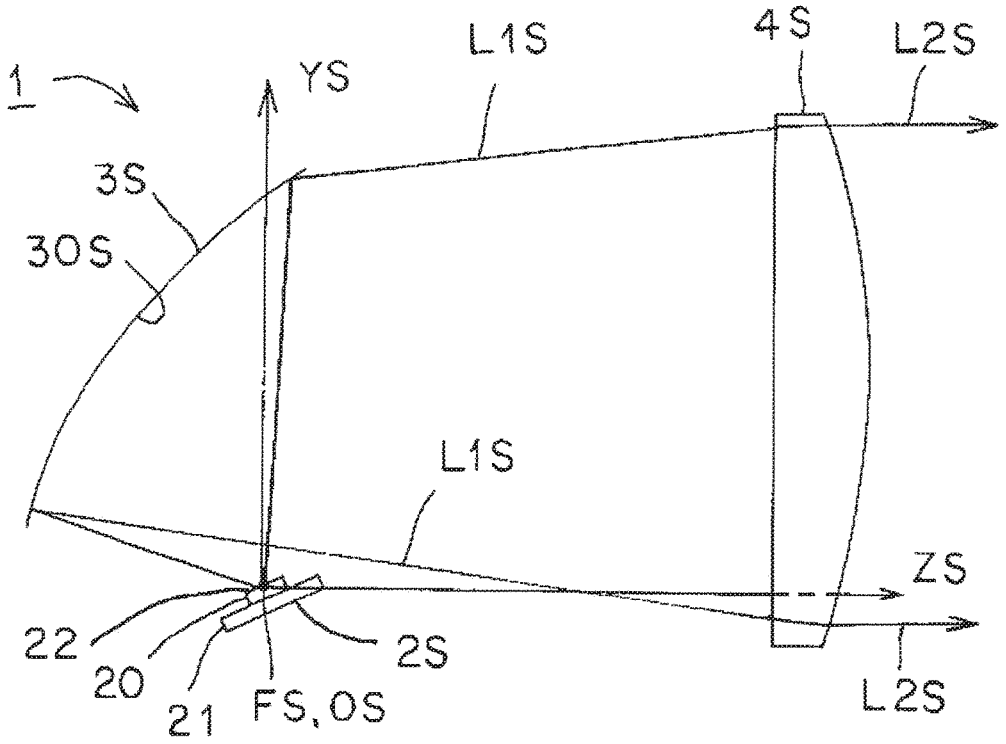
FIG. 2 is a schematic sectional view taken along the line II-II in FIG. 1.
Figure 3:
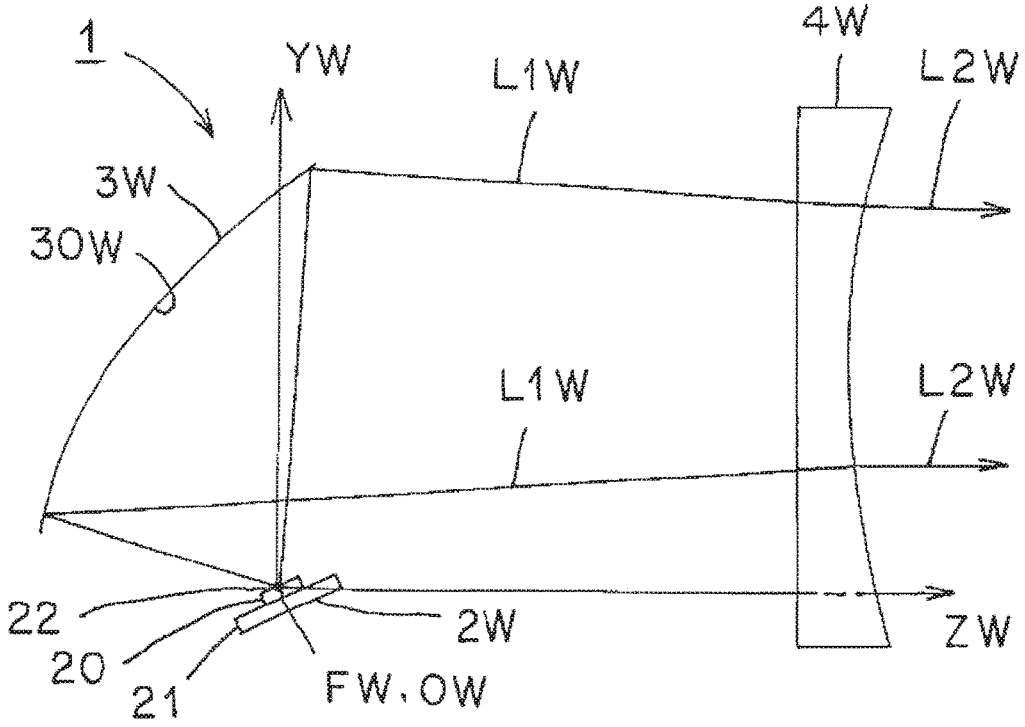
FIG. 3 is a schematic sectional view taken along the line in FIG. 1.

The vehicle headlamp 1, as shown in FIG. 1 to FIG. 3, is provided with: a lamp housing (not shown); a lamp lens (not shown); semiconductor light sources 2S, 2W; reflectors 3S, 3W; lenses 4S, 4W; a heat sink (not shown); and a mounting member (not shown). The heat sink and the mounting member may be compatibly employed as an integral structure.

The semiconductor light sources 2S, 2W, the reflector 3S, 3W, the lenses 4S, 4W, the heat sink member, and the mounting member constitute a lamp unit. The lamp housing and the lamp lens partition a lamp room (not shown). The lamp unit formed of constituent elements 2S, 2W, 3S, 3W, 4S, 4W is disposed in the lamp room and is mounted to the lamp housing via an optical axis adjustment mechanism for vertical direction (not shown) and an optical axis adjustment mechanism for transverse direction (not shown).

(Description of Semiconductor Light Sources 2S, 2W)

The semiconductor light sources 2S, 2W, as shown in FIG. 2 and FIG. 3, are respectively provided with at least a spot semiconductor light source 2S and a diffusion semiconductor light source 2W. The semiconductor light sources 2S, 2W, in this example, are respectively self-emission semiconductor light sources such as an LED, OEF, or an OLEF (an organic EL), for example. The semiconductor light sources 2S, 2W each are composed of: a light emitting chip (a LED chip) 20; a package (an LED package) which has sealed the light emitting chip 20 with a sealing resin member; and a board 21 on which the package has been implemented. The board 21 is fixed to the heat sink member by means of a screw (not shown). As a result, the semiconductor light sources 2S, 2W both are fixed to the heat sink member. An electric current from a power source (a battery) is supplied to the light emitting chip 20 via a connector (not shown) which has been mounted to the board 21.

The light emitting chip 20 forms a planar square shape (a planar rectangular shape). That is, four square chips are arranged in an X-axis direction (a horizontal direction). It is to be noted that two, three, or five or more square chips or one rectangular chip or one square chip may be used. A rectangular upper face (a top face) of the light emitting chip 20 forms a light-emitting surface 22. As a result, the semiconductor light sources 2S, 2W respectively have the light-emitting surfaces 22. The light-emitting surfaces 22 face upward, and in this example, incline at about 20 degrees so as to face the reflection surfaces 30S, 30W with respect to optical axes (reference optical axes, reference axes) ZS, ZW of the reflection surfaces 30S, 30W of the reflectors 3S, 3W, respectively. Centers OS, OW of the light-emitting surfaces 22 of the light emitting chips 20 are respectively positioned at or near focal points (reference focal points) FS, FW of the reflection surfaces 30S, 30W, and are respectively positioned on or near the optical axes ZS, ZW.

In FIG. 1, the axes XS, YS, ZS and XW, YW, ZW constitute a quadrature coordinate system (an X-Y-Z quadrature coordinate system). The XS axis and the XW axis are horizontal axes in the transverse direction passing through the center OS, OW of the light-emitting surface 22, respectively. In so far as the XS axis and the XW axis are concerned, the inside of the vehicle, that is, (the right side in the first embodiment) is in the positive direction, and the outside of the vehicle (that is, the left side in the first embodiment) is in the negative direction. In addition, the YS axis and the YW axis are vertical axes (perpendicular axes, normal lines, perpendicular lines) in the vertical direction passing through the centers OS, OW of the light-emitting surface 22. In so far as the YS axis and the YW axis are concerned, in the first embodiment, the upper side is in the positive direction, and the lower side is in the negative direction. Further, the ZS axis and the ZW axis are the optical axes of the reflection surfaces 30S, 30W, and are also the axes in the longitudinal direction that pass through the centers OS, OW of the light-emitting surface 22 of the light emitting chip 20, and that are respectively orthogonal to the XS axis and the YW axis and the YS axis and the YW axis. In so far as the ZS axis and the ZW axis are concerned, in the first embodiment, the front side is in the positive direction, and the rear side is in the negative direction.

(Description of Reflectors 3S, 3W)

The reflectors 3S, 3W, as shown in FIG. 1 to FIG. 3, are respectively provided with: at least a spot reflector 3S which corresponds to the spot semiconductor light source 2S; and a diffusion reflector 3W which corresponds to the diffusion semiconductor light source 2W. The reflector 3S, 3W each are fixed to at least either one of the heat sink member and the mounting member via a screw or the like (not shown).

The reflectors 3S, 3W respectively have the reflection surfaces 30S, 30W to reflect the light beams as reflection light beams DS, L1W from the light-emitting surfaces 22 of the semiconductor light sources 2S, 2W to the lenses 4S, 4W sides. The reflection surfaces 30S, 30W are respectively composed of free-form surfaces, in this example, free-form surfaces on the basis of parabolas. That is, the reflection surfaces 30S, 30W are respectively reflection surfaces made of parabolic free-form surfaces. As a result, the reflection surfaces 30S, 30W respectively have the focal points FS, FW and the optical axes ZS, ZW. A focal length of each of the reflection surfaces 30S, 30W is about 20 mm (about 20 mm at maximum, less than 20 mm) and is a small focal length.

The reflection surfaces 30W, 30W are respectively provided with: at least a spot reflection surface 30S which corresponds to the spot semiconductor light source 2S; and a diffusion reflection surface 30W which corresponds to the diffusion semiconductor light source 2W. The spot reflection surface 30S, as shown in FIG. 2, is designed in advance so that the reflection light L1S is reflected in the opening direction. The diffusion reflection surface 30W, as shown in FIG. 3, is designed in advance so that the reflection light L1W is reflected in the crossing direction.

(Description of Lenses 4S, 4W)

The lenses 4S, 4W respectively radiate to the front side of the vehicle, the light beams from the light-emitting surfaces 22 of the semiconductor light source 2S, 2W, as predetermined light distribution patterns, the reflection light beams L1S, L1W having been reflected by means of the reflection surfaces 30S, 30W. The lenses 4S, 4W each are composed of one lens, as shown in FIG. 1. The lenses 4S, 4W each are fixed to at least either one of the heat sink member and the mounting member.

The lenses 4S, 4W, as shown in FIG. 1 to FIG. 3, are respectively provided with: at least a spot lens 4S which corresponds to the spot semiconductor light source 2S and the spot reflection surface 30S; and a diffusion lens 4W which corresponds to the diffusion semiconductor light source 2W and the diffusion reflection surface 30W. The spot lens 4S is composed of a convex lens. The diffusion lens 4W is composed of a concave lens. Between the spot lens 4S and the diffusion lens 4W, a gradually varying portion 4 which varies from the convex lens to the concave lens or from the concave lens to the convex lens is provided. A thickness of each of the lenses 4S, 4W is about 6 mm (about 6 mm at maximum, about 6 mm or less) and is small.

The spot lens 4S, as shown in FIG. 2, radiates to the front side of the vehicle from side, the reflection light L1S that has been reflected by means of the spot reflection surface 30S, as emission light L2S which has been corrected to travel along the normal optical path. The diffusion lens 4W, as shown in FIG. 3, radiates to the front side of the vehicle, the reflection light L1W that has been reflected by means of the diffusion reflection surface 30W, as emission light L2W which has been corrected to travel along the normal optical path.

(Description of Spot Lamp Unit Formed of Constituent Elements 2S, 3S, 4S)

The spot semiconductor light source 2S, the spot reflection surface 30S of the spot reflector 3S, and the spot lens 4S constitute a spot lamp unit. The spot lamp unit formed of the constituent elements 2S, 3S, 4S forms a spot light distribution pattern SP1 (refer to FIG. 4 (A)) which is a part of the predetermined light distribution pattern (in this example, a low beam light distribution pattern LP1 shown in FIG. 4 (C)). Both of the low beam light distribution pattern LP1 and the spot light distribution pattern SP1 have a cutoff line CL. The spot lamp unit formed of the constituent elements 2S, 3S, 4S is disposed inside of the vehicle (in this example, the right side).

(Description of Diffusion Lamp Unit Formed of Constituent Elements 2W, 3W, 4W)

The diffusion semiconductor light source 2W, the diffusion reflection surface 30W of the diffusion reflector 3W, and the diffusion lens 4W constitute a diffusion lamp unit. The diffusion lamp unit formed of the constituent elements 2W, 3W, 4W forms a diffusion light distribution pattern WP1 (refer to FIG. 4 (B)) which is a part of the predetermined light distribution pattern (in this example, the low beam light distribution pattern LP1 shown in FIG. 4 (C)). The diffusion lamp unit formed of the constituent elements 2W, 3W, 4W is disposed outside of the vehicle (in this example, the left side). The optical axis ZW of the diffusion reflection surface 30W faces the outside of the vehicle with respect to the optical axis ZS of the spot reflection surface 30S.

(Description of Functions of First Embodiment)

The vehicle headlamp 1 in the first embodiment is made of the constituent elements as described above, and hereinafter, functions thereof will be described.

The light emitting chips 20 of the semiconductor light sources 2S, 2W are lit. Then, the light that is radiated from the light-emitting surface 22 of the spot semiconductor light source 2S, as the reflection light L1S, is reflected in advance to the spot lens 4S side in the opening direction by means of the spot reflection surface L1S. The reflection light L1S is transmitted through the spot lens 4S and then the thus transmitted light is radiated to the front side of the vehicle as the emission light L2S that has been corrected to travel along the normal optical path. The emission light L2S forms a spot light distribution pattern SP1 (refer to FIG. 4 (A)) which is a predetermined light distribution pattern, and which is also a part of the low beam light distribution pattern LP1 shown in FIG. 4 (C).

In addition, the light that is radiated from the light-emitting surface 22 of the diffusion semiconductor light source 2W, as reflection light L1W, is reflected in advance to the diffusion lens 4W side in the crossing direction by means of the diffusion reflection surface 30W. The reflection light L1W is transmitted through the diffusion lens 4W and then the thus transmitted light is radiated to the front side of the vehicle as the emission light L2W that has been corrected to travel along the normal optical path. The emission light L2W forms a diffusion light distribution pattern WP1 (refer to FIG. 4 (B)) which is a predetermined light distribution pattern, and which is also a part of the low beam light distribution pattern LP1 shown in FIG. 4 (C).

Afterwards, the spot light distribution pattern SP1 shown in FIG. 4 (A) and the diffusion light distribution pattern WP1 shown in FIG. 4 (B) are combined (weighted) with each other and then a predetermined light distribution pattern, the low beam light distribution pattern LP1 shown in FIG. 4 (C) is formed.

(Description of Advantageous Effects of First Embodiment)

The vehicle headlamp 1 in the first embodiment is made of the constituent elements and functions as described above, and hereinafter, advantageous effects thereof will be described.

In so far as the vehicle headlamp 1 in the first embodiment is concerned, the spot reflection surface 30S is designed in advance so that the reflection light L1S is reflected in the opening direction, and the reflection light L1S that is reflected in the opening direction is corrected to travel along the normal optical path by means of the convex lens of the spot lens 4S. In addition, the diffusion reflection surface 30W is designed in advance so that the reflection light L1W is reflected in the crossing direction, and the reflection light L1W that is reflected in the opening direction is corrected to travel along the normal optical path by means of the concave lens of the diffusion lens 4W. Therefore, it is possible to accurately control the light distribution of a predetermined light distribution pattern, the low beam light distribution pattern LP1 shown in FIG. 6 (C).

In so far as the vehicle headlamp 1 in the first embodiment is concerned, the lamp unit formed of constituent elements 2S, 3S, 4S, that is composed of the spot semiconductor light source 2S, the spot reflection surface 30S of the spot reflector 3S, and the spot lens 4S, as described previously, is capable of accurately controlling the light distribution of the spot light distribution pattern SP1 (refer to FIG. 4 (A)) that is a predetermined light distribution pattern, and that is also a part of the low beam light distribution pattern LP1 shown in FIG. 4 (C).

Here, the spot lens 4S is composed of a convex lens. Thus, the emission light L2S that is emitted from the spot lens 4S as the convex lens is focused. As a result, the spot lens 4S as the convex lens is optimal to form the spot light distribution pattern SP1 shown in FIG. 4 (A). Moreover, the spot light distribution pattern SP1 formed of the emission light L2S that is emitted from the spot lens 4S as the convex lens is focused, and a vertical width thereof decreases (becomes small). In this manner, in the spot light distribution pattern SP1, a high intensity zone is disposed along the cutoff line CL. As a result, the high intensity zone is disposed along the cutoff line CL of the low beam light distribution pattern LP1 and thus a distant visibility is improved.

In so far as the vehicle headlamp 1 in the first embodiment is concerned, the lamp unit formed of the constituent elements 2W, 3W, 4W, that is composed of the diffusion semiconductor light source 2W, the diffusion reflection surface 30W of the diffusion reflector 3W, and the diffusion lens 4W, as described previously, is capable of accurately controlling the light distribution of the spot light distribution pattern WP1 (refer to FIG. 4 (B)) that is a predetermined light distribution pattern, and that is also a part of the low beam light distribution pattern LP1 shown in FIG. 4 (C).

Here, the diffusion lens 4A is composed of a concave lens. Thus, the emission light L2W that is emitted from the diffusion lens 4A as the concave lens is diffused. As a result, the diffusion lens 4W as the concave lens is optimal to form the diffusion light distribution pattern WP1 shown in FIG. 4 (B). Moreover, the diffusion light distribution pattern WP1 formed of the emission light L2W that is emitted from the diffusion lens 4A as the concave lens is diffused, and a vertical width thereof increases (becomes large). In this manner, in the diffusion light distribution pattern WP1, a low intensity zone increases up to the lower side, that is, up to the front side of the vehicle. As a result, the low intensity zone increases up to the lower side of the low beam light distribution pattern LP1 and thus the visibility of the front side of the vehicle is improved.

In so far as the vehicle headlamp 1 in the first embodiment is concerned, the spot lamp unit formed of the constituent elements 2S, 3S, 4S is disposed inside of the vehicle, and the diffusion lamp unit formed of the constituent elements 2W, 3W, 4W is disposed outside of the vehicle. Thus, the distant visibility is further improved by the spot lamp unit formed of the constituent elements 2S, 3S, 4S, that is formed inside of the vehicle. In addition, the diffusion lamp unit formed of the constituent elements 2W, 3W, 4W, that is disposed outside of the vehicle, the visibility of the left and right outsides of the vehicle, that is, the left and right shoulders, is improved.

In so far as the vehicle headlamp 1 in the first embodiment is concerned, the optical axis ZW of the diffusion reflection surface 30W faces the outside of the vehicle with respect to the optical axis ZS of the spot reflection surface 30S. Thus, the visibility of the left and right outsides of the vehicle, that is, the left and right shoulders, is further improved. Moreover, this circumstance is optimal in a case where the shape of each of the left and right end parts at the front part of the vehicle is a wrapping shape and the shape of the lamp lens is the wrapping shape.

In so far as the vehicle headlamp 1 in the first embodiment is concerned, the focal length of each of the reflection surfaces 30S, 30W is about 20 mm or less and is a small focal length. Thus, the reflection surfaces 30S, 30W, that is, the reflector 3S, 3W can be downsized. If the reflectors 3S, 3W, that is, the reflection surfaces 30S, 30W are thus downsized, the areas of reflection projection images of the light-emitting surfaces 22 of the reflection surfaces 30S, 30W increase. Therefore, in so far as the vehicle headlamp 1 in the first embodiment is concerned, the light-emitting surfaces 22 are inclined so as to face the reflection surfaces 30S, 30W with respect to the optical axes ZS, ZW of the reflection surfaces 30S, 30W. In this manner, even if the reflection surfaces 30S, 30W are downsized, the areas of the reflection projection images of the light-emitting surfaces 22 from the reflection surfaces 30S, 30W can be reduced to a certain extent. Moreover, in so far as the vehicle headlamp 1 in the first embodiment is concerned, the lenses 4S, 4W are respectively disposed at the reflection direction sides of the reflection surfaces 30S, 30W; and therefore, it is possible to further reduce the areas of the reflection projection images of the light-emitting surfaces 22 of the reflection surfaces 30S, 30W. In this manner, it is possible to form the predetermined light distribution patterns SP1, WP1, LP1.

In so far as the vehicle headlamp 1 in the first embodiment is concerned, the thickness of each of the lenses 4S, 4W is about 6 mm at maximum and is small. That is, the vehicle headlamp 1 in the first embodiment is capable of downsizing the reflection surfaces 30S, 30W to thereby reduce the thickness of each of the lenses 4S, 4W. In this manner, the spot lens 4S as the convex lens and the diffusion lens 4W as the concave lens each can be composed of one lens. The lenses 4S, 4W each are composed of one lens to be thereby able to reduce the number of parts and the manufacturing costs.

(Description of Configuration of Second Embodiment)

FIG. 5 to FIG. 8 each show a second embodiment of a vehicle headlamp according to the present invention. In the figures, the same constituent elements in FIG. 1 to FIG. 4 are designated by the same reference numerals.

The diffusion reflection surface 30W of the vehicle headlamp 1 in the first embodiment described previously, as shown in FIG. 3, is designed in advance so that the reflection light L1W is reflected in the crossing direction. On the other hand, a diffusion reflection surface 32W of a vehicle headlamp 12 in the second embodiment, as shown in FIG. 7, is designed in advance so that reflection light L12W is reflected in an opening direction.

The diffusion lens 4W of the vehicle headlamp 1 in the first embodiment described previously, as shown in FIG. 1 and FIG. 3, is composed of the concave lens. On the other hand, a diffusion lens 42W of the vehicle headlamp 12 in the second embodiment, as shown in FIG. 5 and FIG. 7, is composed of a convex lens. The diffusion lens 42W, as shown in FIG. 7, radiates to the front side of the vehicle, the reflection light L12W that has been reflected in the opening direction by means of the diffusion reflection surface 32W, as emission light L22W which has been corrected to travel along a normal optical path.

(Description of Functions of Second Embodiment)

The vehicle headlamp 12 in the second embodiment described previously is made of the constituent elements as described above and thus from a lamp unit formed of the constituent elements 2S, 3S, 4S, a spot light distribution pattern SP1 (refer to FIG. 8 (A) which is a predetermined light distribution, and which is also a part of the low beam light distribution pattern LP2 shown in FIG. 8 (C), is radiated to a front side of a vehicle. The spot light distribution pattern SP1 is similar or substantially similar to the spot light distribution pattern SP1 of the vehicle headlamp 1 in the first embodiment.

From a diffusion lamp unit formed of the constituent elements 2W, 3W (32W), 42W, a diffusion light distribution pattern WP2 (refer to FIG. 8 (B)) which is a predetermined light distribution pattern, and which is also a part of the low beam light distribution pattern LP2 shown in FIG. 8 (C), is radiated to the front side of the vehicle.

Afterwards, the spot light distribution pattern SP1 shown in FIG. 8 (A) and the diffusion light distribution pattern WP2 shown in FIG. 8 (B) are combined (weighted) with each other, and a predetermined light distribution pattern, the low beam light distribution pattern LP2 shown in FIG. 8 (C) is formed.

(Description of Advantageous Effects of Second Embodiment)

The vehicle headlamp 12 in the second embodiment described previously is made of the constituent elements and functions as described above; and therefore, it is possible to achieve advantageous effects which are similar to those of the vehicle headlamp 1 in the first embodiment.

In particular, in so far as the vehicle headlamp 12 in the second embodiment is concerned, the diffusion reflection surface 32W is designed in advance so that the reflection light L12W is reflected in the opening direction and the diffusion lens 42W is composed of a convex lens so as to radiate the reflection light L12W to the front side of the vehicle as the emission light L22W that has been corrected to travel along the normal optical path. Thus, the emission light L22W that is emitted from the diffusion lens 42W as the convex lens is focused. As a result, the diffusion light distribution pattern WP2 formed of the emission light L22W that is emitted from the diffusion lens 42W as the convex lens is focused and a vertical width thereof decreases (becomes small). In this manner, in the diffusion light distribution pattern WP2, a high intensity zone is disposed at an upper side. As a result, by way of combination with the spot light distribution pattern SP1 shown in FIG. 8 (A), the high intensity zone is disposed to be transversely broad along the cutoff line CL of the low beam light distribution pattern LP2 and thus a distant visibility is further improved.

(Description of Configuration of Third Embodiment)

FIG. 9 to FIG. 12 each show a third embodiment of a vehicle headlamp according to the present invention. In the figures, the same constituent elements in FIG. 1 to FIG. 8 are designated by the same reference numerals.

Figure 10:
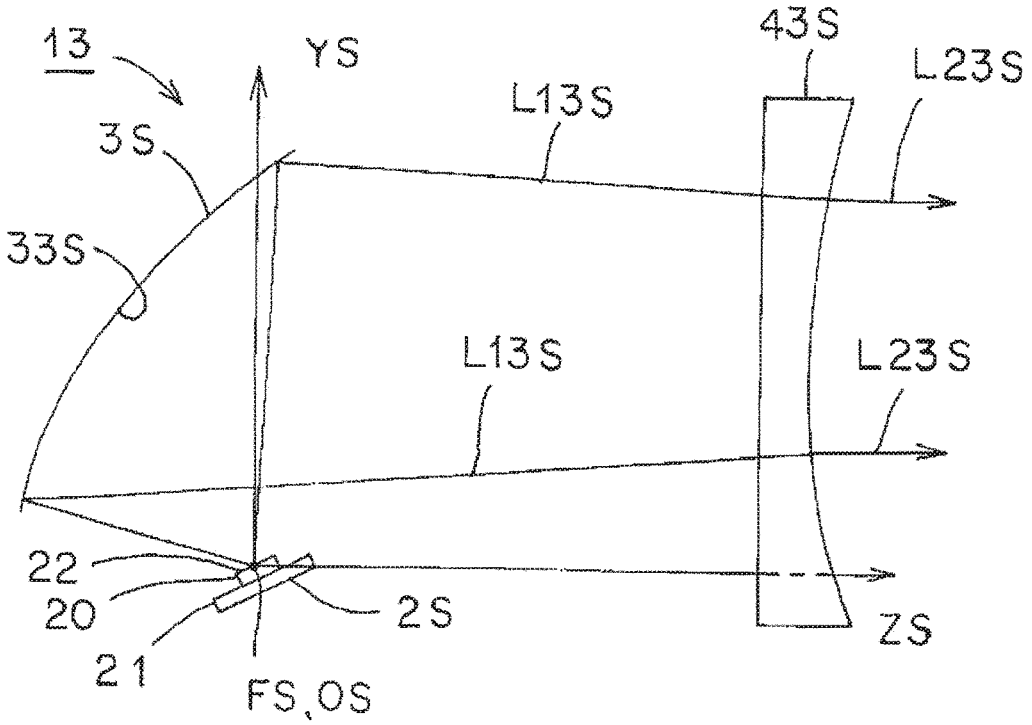
FIG. 10 is a schematic sectional view taken along the line X-X in FIG. 9.
Figure 11:
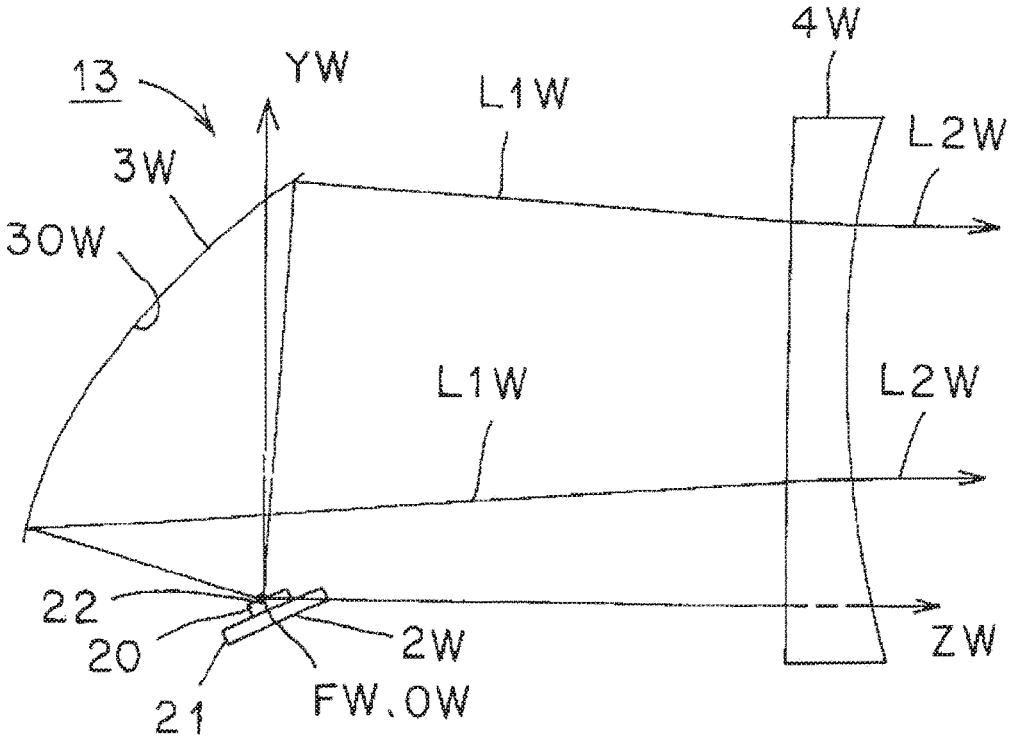
FIG. 11 is a schematic sectional view taken along the line XI-XI in FIG. 9.

The spot reflection surface 30S of the vehicle headlamp 1 in the first embodiment described previously, as shown in FIG. 2, is designed in advance so that the reflection light L1S is reflected in the opening direction. On the other hand, a spot reflection surface 33S of a vehicle headlamp 13 in the third embodiment, as shown in FIG. 10, is designed in advance so that reflection light L13S is reflected in a crossing direction.

The spot lens 4S of the vehicle headlamp 1 in the first embodiment described previously, as shown in FIG. 1 and FIG. 2, is composed of the convex lens. A spot lens 43S of the vehicle headlamp 13 in the third embodiment, as shown in FIG. 9 and FIG. 10, is composed of a concave lens. The spot lens 43S, as shown in FIG. 10, radiates to the front side of the vehicle, the reflection light L13S that has been reflected in the crossing direction by means of the spot reflection surface 33S, as the emission light L23S that has been corrected to travel a normal optical path.

(Description of Functions of Third Embodiment)

The vehicle headlamp 13 in the third embodiment is made of the constituent elements as described above and thus from a lamp unit formed of the constituent elements 2S, 3S (33S), 4S, a spot light distribution pattern SP3 (refer to FIG. 12 (A)) which is a predetermined light distribution pattern, and which is also a part of the low beam light distribution pattern LP3 shown in FIG. 12 (C), is radiated to the front side of the vehicle.

From the lamp unit formed of the constituent elements 2W, 3W, 4W, a diffusion light distribution pattern WP1 (refer to FIG. 12 (B) which is a predetermined light distribution pattern, and which is also a part of the low beam light distribution pattern LP3 shown in FIG. 12 (C), is radiated to the front side of the vehicle. The diffusion light distribution pattern WP1 is similar or substantially similar to the diffusion light distribution pattern WP1 of the vehicle headlamp 1 in the first embodiment described previously.

Afterwards, the spot light distribution pattern SP3 shown in FIG. 12 (A) and the diffusion light distribution pattern WP1 shown in FIG. 12 (B) are combined (weighted) with each other, and a predetermined light distribution pattern, the low beam light distribution pattern LP3 shown in FIG. 12 (C) is formed.

(Description of Advantageous Effects of Third Embodiment)

The vehicle headlamp 13 in the third embodiment described previously is made of the constituent elements and functions as described above and thus it is possible to achieve advantageous effects which are similar to those of the vehicle headlamp 1 in the first embodiment described previously and the vehicle headlamp 12 in the second embodiment described previously.

In particular, in so far as the vehicle headlamp 13 in the third embodiment is concerned, the spot reflection surface 33S is designed in advance so that the reflection light L13S is reflected in the crossing direction and the spot lens 43S is composed of a concave lens so as to radiate the reflection light L13S to the front side of the vehicle, as the emission light L23S that has been corrected to travel along the normal optical path. Thus, the emission light L23S that is emitted from the spot lens 43S as the concave lens is diffused. As a result, the spot light distribution pattern SP3 formed of the emission light L23S that is emitted from the spot lens 43S as the concave lens is diffused and a vertical width thereof increases (becomes large). In this manner, in the spot light distribution pattern SP3, a low intensity zone increases to the lower side, that is, the front side of the vehicle. As a result, by way of combination with the diffusion light distribution pattern WP1 shown in FIG. 12 (B), the low intensity zone increases up to the lower side of the low beam light distribution pattern LP3 and thus the visibility of the front side of the vehicle is further improved.

(Description of Configuration of Fourth Embodiment)

Figure 13:
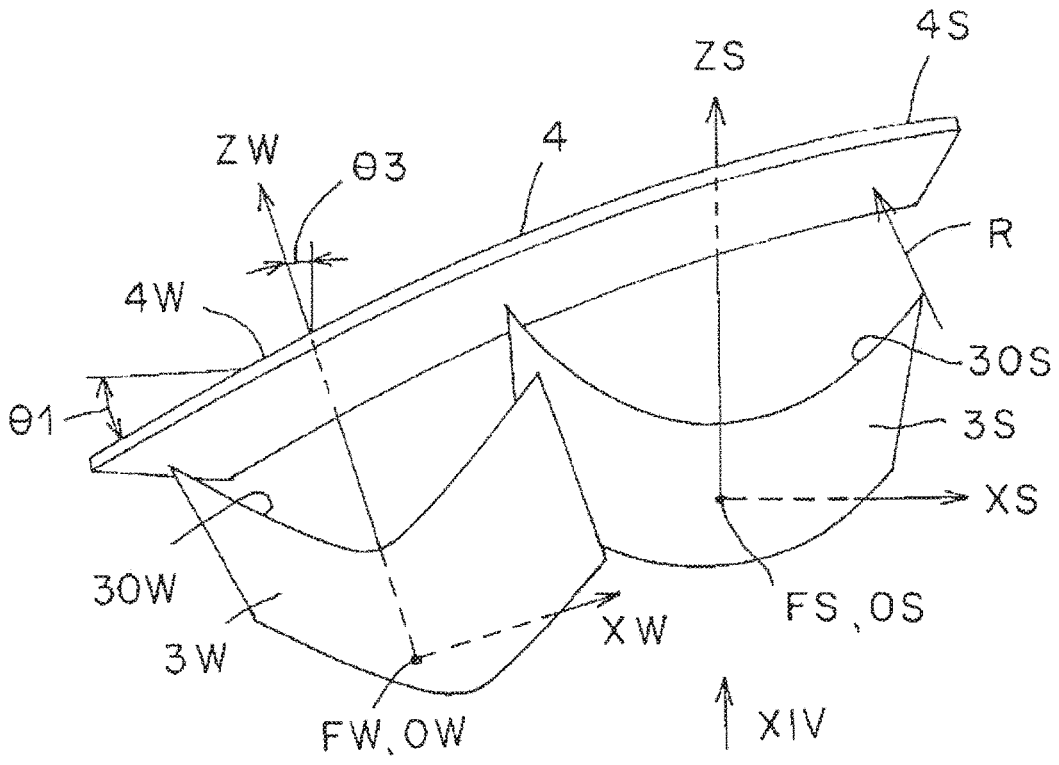
FIG. 13 is a schematic plan view showing a fourth embodiment of a vehicle headlamp according to the present invention.
Figure 14:
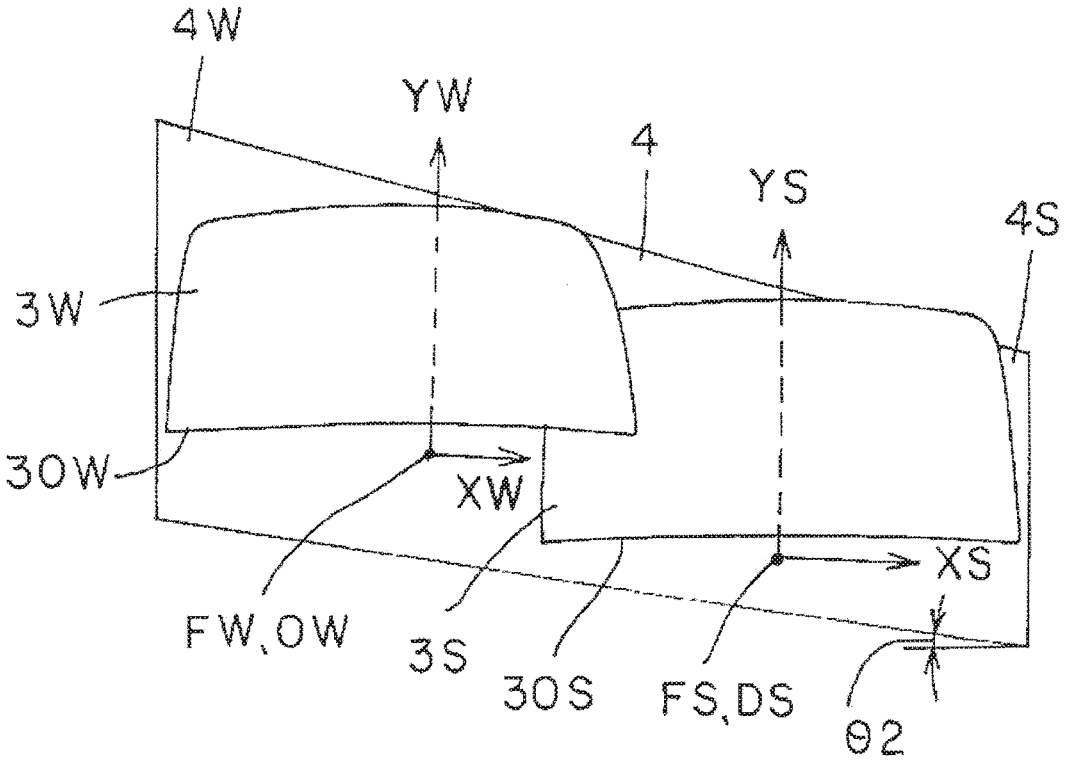
FIG. 14 is a schematic view (a schematic rear view) indicated by the arrow XIV in FIG. 13.

FIG. 13 and FIG. 14 each show a fourth embodiment of a vehicle headlamp according to the present invention. In the figures, the same constituent elements in FIG. 1 to FIG. 12 are designated by the same reference numerals.

A vehicle headlamp 14 in the fourth embodiment is a modification example of the vehicle headlamp 1 in the first embodiment described previously. That is, the vehicle headlamp 14 in the fourth embodiment forms a structure and a shape along a design shape at each of the left and right end parts at the front part of a vehicle.

A shape in a planar view of each of the lenses 4S, 4, 4W, as shown in FIG. 13, forms a curved shape of a radius R (in this example, about 300 mm). In addition, the shape in the planar view of each of the lenses 4S, 4, 4W, as shown in FIG. 13, inclines at an angle of θ1 (in this example, about 20 degrees) from the vehicle inside (the right side in FIG. 13) to the outside (the left side in FIG. 13), from the front side (the upper side in FIG. 13) to the rear side (the lower side in FIG. 13) of the vehicle. Further, a shape in a rear view of each of the lenses 4S, 4, 4W, as shown in FIG. 14, inclines at an a angle of θ2 (in this example, about 10 degrees) from the inside (the right side in FIG. 14) to the outside (the left side in the FIG. 14) of the vehicle, from the lower side to the upper side of the vehicle.

The optical axis ZW of the diffusion reflection surface 30W of the diffusion reflector 3W, as shown in FIG. 13, inclines to the outside of the vehicle at an angle of θ3 (in this example, about 15 degrees) with respect to the optical axis ZS of the spot reflection surface 30S of the spot reflector 3S. It is to be noted that a light-emitting surface of a semiconductor light source faces upward, and in this example, inclines at an angle of about 20 degrees so as to face the reflection surfaces 30S, 30W with respect to the optical axes ZS, ZW of the reflection surfaces 30S, 30W of the reflectors 3S, 3W.

The left and right of the focal point FW of the diffusion reflection surface 30A of the diffusion reflector 3W (a center OW of the light-emitting surface of the diffusion semiconductor light source) and the focal point FW of the spot reflection surface 30S of the spot reflector 3S (a center OS of the light-emitting surface of the spot semiconductor light source), as shown in FIG. 13 and FIG. 14, have intervals of a predetermined distance (in this example, about 40 mm). In addition, the front and rear of the focal point FW of the diffusion reflection surface 30W of the diffusion reflector 3W (a center OW of the light-emitting surface of the diffusion semiconductor light source) and the focal point FW of the spot reflection surface 30S of the spot reflector 3S (a center OS of the light-emitting surface of the spot semiconductor light source), as shown in FIG. 13, have intervals of a predetermined distance (in this example, about 20 mm). Further, the top and bottom of the focal point FW of the diffusion reflection surface 30W of the diffusion reflector 3W (the center OW of the light-emitting surface of the diffusion semiconductor light source) and the focal point FW of the spot reflection surface 30S of the spot reflector 3S (the center OS of the light-emitting surface of the spot semiconductor light source), as shown in FIG. 14, have intervals of a predetermined distance (in this example, about 12 mm).

(Description of Functions and Advantageous Effects of Fourth Embodiment)

The vehicle headlamp 14 in the fourth embodiment is made of the constituent elements as described above and thus it is possible to achieve functions and advantageous effects which are substantially similar to those of the vehicle headlamp 1 in the first embodiment described previously.

It is to be noted that, in the vehicle headlamp 2 in the second embodiment described previously and the vehicle headlamp 3 in the third embodiment described previously as well, there may be a structure and a shape along a design shape at each of the left and right end parts at the front part of the vehicle as in a modification example of the vehicle headlamp 1 in the first embodiment described previously, that is, the vehicle headlamp 14 in the fourth embodiment.

(Description of Examples Other Than First to Forth Embodiments)

In the first to third embodiments, the vehicle headlamps 1, 12, 13 in a case where a vehicle is for left side cruising were described. However, in the present invention, it is possible to apply to a vehicle headlamp in a case where a vehicle is for right side cruising as well.

In addition, in the first to fourth embodiments, the light-emitting surfaces 22 of the light emitting chips 20 of the semiconductor light sources 2S, 2W face upward. However, in the present invention, it may be that the light-emitting surfaces 22 of the light emitting chips 20 of the semiconductor light sources 2S, 2W face downward. That is, in FIG. 1 to FIG. 3, FIG. 5 to FIG. 7, and FIG. 9 to FIG. 11, it may be that the semiconductor light sources 2S, 2W, the reflector 3S, 3W (the reflection surfaces 30S, 30W, 32S, 33S) and the lenses 4S, 4W, 42W, 43S are disposed to be vertically reversed from each other.

Further, in the first to fourth embodiments, the light-emitting surfaces 22 are respectively inclined so as to face the reflection surfaces 30S, 30W, 32W, 33S with respect to the optical axes ZS, ZW of the reflection surfaces 30S, 30W, 32W, 33S. However, in the present invention, the light-emitting surfaces 22 may not be inclined.

Furthermore, in the first to fourth embodiments, in each of the lenses 4S, 4W, 42W, 43S, an incidence surface forms a plane, and an emission surface forms a convex surface or a concave surface. However, in the present invention, it may be that the incidence surface forms a convex surface or a concave surface, the emission surface forms a plane, or alternatively, it may be that the incidence surface and the emission surface respectively form a convex surface and a concave surface.

Still furthermore, in the first to fourth embodiments, the optical axis ZW of the diffusion reflection surface 30W faces the outside of the vehicle with respect to the optical axis ZS of the spot reflection surface 30S. However, in the present invention, it may be that the optical axis ZW of the diffusion reflection surface 30W and the optical axis ZS of the spot reflection surface 30S are parallel or substantially parallel to each other.

Yet furthermore, in the first to fourth embodiments, the focal length of each of the reflection surfaces 30S, 33S, 30W, 32W is about 20 mm or less, and the thickness of each of the lenses 4S, 43S, 4W, 42W is about 6 mm or less. However, in the present invention, the focal length of each of the reflection surfaces 30S, 33S, 30W, 32W and the thickness of each of the lenses 4S, 43S, 4W, 42W are not limitative in particular.

The invention claimed is:

1. A vehicle headlamp comprising:

a semiconductor light source;

a reflector; and a lens, wherein the semiconductor light source has a light-emitting surface, the reflector has a reflection surface to reflect light from the light-emitting surface to the lens's side, and the lens radiates to a front side of a vehicle, the light reflected by means of the reflection surface, as a predetermined light distribution pattern, and wherein the semiconductor light source comprises a first semiconductor light source and a second semiconductor light source, the reflection surface comprises a first reflection surface which corresponds to the first semiconductor light source, and a second reflection surface which corresponds to the second semiconductor light source, the lens comprises a first lens which corresponds to the first semiconductor light source and the first reflection surface, and a second lens which corresponds to the second semiconductor light source and the second reflection surface, and the first semiconductor light source, the first reflection surface, and the first lens are arranged to form a spot light distribution pattern and the second semiconductor light source, the second reflection surface, and the second lens are arranged to form a diffusion light distribution pattern so that the spot light distribution pattern and the diffusion light distribution pattern are combined to form the predetermined light distribution pattern.

2. The vehicle headlamp according to claim 1, wherein the first semiconductor light source, the first reflection surface, and the first lens are disposed inside the vehicle, and the second semiconductor light source, the second reflection surface, and the second lens are disposed outside the vehicle.

3. The vehicle headlamp according to claim 2,

Wherein the optical axis of the second reflection surface faces the outside of the vehicle with respect to the optical axis of the first reflection surface.

4. The vehicle headlamp according to claim 1, wherein the first lens is a convex lens, and the second lens is a concave lens.

5. The vehicle headlamp according to claim 1, wherein the reflection surface is composed of a free-form surface, and the light-emitting surface inclines so as to face the reflection surface with respect to an optical axis of the reflection surface.

* * * * *